United States Patent [19]

Oakes

[11] Patent Number: 4,539,132

[45] Date of Patent: Sep. 3, 1985

[54] BLEACHING AND CLEANING COMPOSITION

[75] Inventor: John Oakes, Ellesmere Port, England

[73] Assignee: Lever Brothers Company, New York, N.Y.

[21] Appl. No.: 606,724

[22] Filed: May 3, 1984

[30] Foreign Application Priority Data

May 4, 1983 [GB] United Kingdom ..... 8312185

[51] Int. Cl.[3] ..... C11D 7/18; C11D 7/42

[52] U.S. Cl. ..... 252/95; 252/99; 252/174.12; 252/186.38; 252/186.42; 252/DIG. 12

[58] Field of Search ..... 252/186.38, 186.42, 252/95, 99, 174.12, DIG. 12

[56] References Cited

U.S. PATENT DOCUMENTS

| | | | |
|---|---|---|---|
| 3,156,654 | 11/1964 | Konecny et al. | 252/95 |
| 3,372,125 | 3/1968 | Hill et al. | 252/99 |
| 3,398,096 | 8/1968 | Das et al. | 252/95 |
| 3,532,634 | 10/1970 | Woods | 252/95 |
| 4,119,557 | 10/1978 | Postlethwaite | 252/99 |
| 4,381,247 | 4/1983 | Nakagawa et al. | 252/95 |
| 4,430,243 | 2/1984 | Bragg | 252/91 |

FOREIGN PATENT DOCUMENTS

| | | |
|---|---|---|
| 72166 | 2/1983 | European Pat. Off. . |
| 82563 | 6/1983 | European Pat. Off. . |
| 1940654 | 2/1971 | Fed. Rep. of Germany . |
| 2158487 | 5/1972 | Fed. Rep. of Germany . |
| 60582 | 3/1970 | Luxembourg . |
| 984459 | 2/1965 | United Kingdom . |
| 1349650 | 4/1974 | United Kingdom . |
| 1356130 | 12/1974 | United Kingdom . |

*Primary Examiner*—Prince E. Willis

*Attorney, Agent, or Firm*—Milton L. Honig; James J. Farrell

[57] ABSTRACT

Bleaching and cleaning compositions having improved bleaching and cleaning capacity are disclosed which comprise a peroxide compound bleach, e.g. sodium perborate, a proteolytic enzyme and manganese (II) metal. The bleaching and cleaning compositions are effective for washing fabrics at substantially all washing temperatures, and are usable for example in washing machines at lower than 60° C. wash cycle.

10 Claims, No Drawings

BLEACHING AND CLEANING COMPOSITION

This invention relates to bleaching and cleaning compositions comprising a peroxide bleach. In particular, it relates to bleaching and cleaning compositions comprising a peroxide bleach and a proteolytic enzyme having improved bleaching and cleaning capacity at all temperatures, but especially at lower temperatures.

Bleaching and cleaning compositions comprising a peroxide bleaching agent are known in the art. Useful peroxide bleaching agents of the art include hydrogen peroxide, urea peroxide and the alkali metal perborates, percarbonates, perphosphates and persilicates. These bleaching agents are effective in removing stains having a significant content of colouring matter, such as tea, coffee, fruit, wine and cosmetic stains, but they are relatively ineffective in the removal of proteinaceous stains such as blood, milk and cocoa stains.

These latter stains can be effectively removed by the use of proteolytic enzymes. It is for this reason that most of the present-day detergent and bleaching compositions, especially laundry detergent and bleaching compositions, have therein incorporated both a peroxygen bleach, e.g. sodium perborate or sodium percarbonate, and a proteolytic enzyme for improved cleaning capacity and removal of a wider range of stains.

One drawback of peroxide compound bleaching agents is, however, that they are relatively ineffective at lower temperatures, i.e. up to 70° C., and hence cleaning compositions comprising a peroxide compound bleaching agent have to be used at near boiling temperatures in order to achieve a satisfactory bleaching and stainremoving effect.

It is known that heavy metal ions of the transition series, particularly chromium, manganese, iron, cobalt, nickel and copper ions, have a catalysing effect on the decomposition of peroxide compounds.

The use of heavy metal ions in conjunction with special types of chelating agents or sequestrants as catalysts for peroxide bleaching agents is described in U.S. Pat. Nos. 3,156,654, 3,532,634 and 4,119,557, in British Patent No. 984,459 and in European Patent Application No. 0072166. A disadvantage of these systems is that they are only effective as a catalyst at higher temperatures. At lower temperatures, i.e. below 60° C., the presence of these special types of chelating agents as proposed in the art tends to suppress the catalytic activity of the heavy metal ions on peroxide compound bleaches.

Furthermore, if used in washing at lower temperatures, heavy metals of the transition series tend to catalyse the decomposition of peroxide compounds, causing a reduction of the bleaching action rather than catalysing the bleaching action. They also tend to decompose proteolytic enzymes, causing a reduction of enzyme action.

It has now surprisingly been found that only manganese is an effective bleach catalyst even at lower temperatures without detrimentally affecting the proteolytic enzyme action on protein stains. The advantage of manganese is such that it even exerts a synergistic effect with proteolytic enzymes of some types on the removal of protein stains. This effect is unique to manganese and cannot be observed with other members of the transition metal series.

The catalysing effect of manganese ions is not only observed at lower temperatures, but also at medium and higher temperatures, and is thus an effect that is observable at the whole wash-temperature range, i.e. from ambient to boiling temperatures.

The effective manganese ion according to the invention is manganese (II) cation.

European Patent Application No. 0082563, published 29th June, 1983, discloses peroxide bleach compositions containing manganese (II) in conjunction with carbonate compounds. Although enzymes are mentioned amongst a range of other ingredients which may be incorporated, no further details are given, nor has the combined use of enzyme with manganese (II) catalysed bleach in one composition been demonstrated.

The invention therefore broadly provides an effective bleaching and cleaning composition comprising a peroxide compound bleaching agent, a proteolytic enzyme and manganese (II) cation.

The present invention is of particular benefit for bleaching and cleaning compositions having an alkaline reaction, preferably having a solution pH of from 8–13, particularly from 8.5–12.

The peroxide compound bleaching agent which can be used in the present invention is generally hydrogen peroxide or any of its solid adducts, such as urea peroxide, alkali metal perborates, persilicates and perphosphates. Preferred peroxide compounds are hydrogen peroxide (for liquid compositions) and the alkali metal perborates (for solid compositions), especially sodium perborate.

A typical level of these peroxide compounds in the composition of the invention is within the range from about 4% to about 35% by weight. However, the composition of the invention can also take the form of a bleach additive product for addition at the point of use either to a wash liquor or to a non-bleaching detergent composition. In that case the percompound bleach may be present at even higher levels of up to about 90% by weight of the composition.

The proteolytic enzymes which are suitable for use in the present invention are normally solid, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4-12 are available and can be used in the composition of the present invention. Examples of suitable proteolytic enzymes are the subtilisins which are obtained from particular strains of B. subtilis and B. licheniformis, such as the commercially available subtilisins Maxatase ®, as supplied by Gist-Brocades N.V., Delft, Holland, and Alcalase ®, as supplied by Novo Industri A/S, Copenhagen, Denmark.

Particularly suitable is a protease obtained from a strain of Bacillus having maximum activity throughout the pH range of 8-12, being commercially available e.g. from Novo Industri A/S under the registered trade names Esperase ® and Savinase ®. The preparation of these and analogous enzymes is described in British Patent Specification No. 1,243,784.

The amount of proteolytic enzymes normally used in the composition of the invention may range from 0.001% to 10% by weight, preferably from 0.01% to 5% by weight, depending upon their activity. They are generally incorporated in the form of granules, prills or "marumes" in an amount such that the final washing product has proteolytic activity of from about 2-20 Anson units per kilogram of final product.

The manganese ion used according to the invention can be derived from any manganese (II) salt, such as manganese sulphate ($MnSO_4$) and manganese chloride ($MnCl_2$) or from any other manganese compound which yields manganese (II) cations in aqueous solution. Manganese salts and complexes, such as manganese EDTA complex, are preferred.

The optimum level of manganese (II) cation in the wash/bleach solution will depend upon the formulation in which the manganese as bleach catalyst is applied. In terms of parts per million (ppm) a suitable range will generally be from about 0.1 to 50 ppm, preferably from 0.5-25 ppm of manganese (II) ions, with its optimum at above 5 ppm.

These will correspond roughly to a manganese (II) metal content in a bleaching and cleaning composition of about 0.005-5% by weight, preferably from 0.025-2.5%, more preferably from 0.05-1.0% by weight of the composition.

Accordingly, a bleaching and cleaning composition of the invention will generally comprise:

(a) from 4 to 90% by weight of a peroxide compound bleach;

(b) from 0.001 to 10% by weight of a proteolytic enzyme; and (c) from 0.005 to 5% by weight of manganese (II).

Usually the bleaching and cleaning compositions of the invention will also include at least one organic soap or synthetic detergent-active material. Preferably, from about 2% to 50% by weight of an organic anionic, non-ionic, amphoteric or zwitterionic detergent compound, soap or mixtures thereof are included. Many suitable detergent-active compounds are commercially available and are fully described in the literature, for example in "Surface Active Agents and Detergents", Volumes I and II, by Schwartz, Perry and Berch.

The preferred detergent-active compounds which can be used are synthetic anionic, soap and nonionic compounds. The first-mentioned are usually water-soluble alkali metal salts of organic sulphates and sulphonates having alkyl radicals containing from about 8 to about 22 carbon atoms, the term alkyl being used to include the alkyl portion of higher aryl radicals. Examples of suitable anionic detergent compounds are sodium and potassium alkyl sulphates, especially those obtained by sulphating higher ($C_8$'$C_{18}$) alcohols produced for example from tallow or coconut oil; sodium and potassium alkyl ($C_9$-$C_{20}$) benzene sulphonates, particularly sodium linear secondary ($C_{10}$-$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_{9-C18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$-$C_{20}$) with sodium bisulphate and those derived by reacting paraffins with $SO_2$ and $Cl_2$ and then hydrolyzing with a base to produce a random sulphonate; olefin sulphonates, which term is used to describe the material made by reacting olefins, particularly $C_{10}$-$C_{20}$ alpha-olefins, with $SO_3$ and then neutralizing and hydrolyzing the reaction product: and alkali metal salts of long-chain $C_8$-$C_{22}$ fatty acids such as the sodium soaps of tallow, coconut oil, palmkernel oil, palm oil or hardened rapeseed oil fatty acids or mixtures thereof. The preferred anionic detergent compounds are sodium ($C_{11}$-$C_{15}$) alkyl benzene sulphonates and sodium ($C_{16}$-$C_{18}$) alkyl sulphates.

Examples of suitable nonionic detergent compounds which may be used include the reaction products of alkylene oxides, usually ethylene oxide, with alkyl ($C_6$-$C_{22}$) phenols, generally 5 to 25 EO, i.e. 5 to 25 units of ethylene oxide per molecule; the condensation products of aliphatic ($C_8$-$C_{18}$) primary or secondary linear or branched alcohols with ethylene oxide, generally 6 to 30 EO, and products made by condensation of ethylene oxide with the reaction products of propylene oxide and ethylene diamine. Other so-called nonionic detergent compounds include long-chain tertiary amine oxides, long-chain tertiary phosphine oxides and dialkyl sulphoxides.

Mixtures of detergent-active compounds, for example mixed anionic or mixed anionic and nonionic compounds, may be used in the detergent compositions, particularly in the latter case to provide controlled low sudsing properties. This is beneficial for compositions intended for use in suds-intolerant automatic washing machines.

Amounts of amphoteric or zwitterionic detergent-active compounds can also be used in the compositions of the invention, but this is not normally desired owing to their relatively high cost. If any amphoteric or zwitterionic detergent-active compounds are used, it is generally in small amounts in compositions based on the much more commonly used synthetic anion and/or nonionic detergent-active compounds.

The bleaching and cleaning compositions of the invention also usually contain from about 5% to about 90% of detergency builder, preferably from about 15% to about 60% thereof.

Suitable detergency builder salts useful herein can be of the polyvalent inorganic and polyvalent organic types, or mixtures thereof. Non-limiting examples of suitable water-soluble, inorganic alkaline detergency builder salts include the alkali metal borates; orthophosphates; polyphosphates, such as tripolyphosphates, pyrophosphates; carbonates and bicarbonates; and silicates.

Examples of suitable organic alkaline detergency builder salts are water-soluble polycarboxylates such as the salts of nitrilotriacetic acid, lactic acid, glycollic acid and ether derivatives thereof as disclosed in Belgian Pat. Nos. 821,368, 821,369 and 821,370; succinic acid, malonic acid, (ethylenedioxy)diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane cis, cis,cis-tetracarboxylic acid, cyclopentadienide pentacarboxylic acid, 2,3,4,5-tetrahydrofuran-cis, cis, cis-tetracarboxylic acid, 2,5-tetra-hydrofuran-cis-dicarboxylic acid, 1,2,3,4,5,6-hexane-hexacarboxylic acid, mellitic acid, pyromellitic acid and the phthalic acid derivatives disclosed in British Patent No. 1,425,343.

Mixtures of organic and/or inorganic builders can be used herein.

A further class of builder salts is the insoluble aluminosilicate type which functions by cation exchange to remove polyvalent mineral hardness and heavy metal ions of formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Patent Specification No. 1,429,143, German Patent Application No. OLS 2,433,485 and OLS 2,525,778, the disclosures of which are incorporated herein by reference. Typical examples of aluminosilicates are commercially obtainable under the name of zeolites.

Apart from the components already mentioned, the composition of the invention can contain any of the conventional additives in the amounts in which such materials are normally employed in fabric-washing detergent compositions. Examples of these additives include lather boosters such as alkanolamides, particularly the monoethanolamides derived from palmkernel fatty acids and coconut fatty acids; lather depressants such as alkyl phosphates and silicones; soil-suspending and anti-redeposition agents such as sodium carboxymethylcellulose, polyvinyl pyrrolidone and the cellulose ethers such as methyl cellulose and ethyl hydroxyethyl cellulose; stabilizers such as ethylenediamine tetraacetic acid, ethylenediamine tetramethylene phosphonate and diethylenetriamine pentamethylene phosphonate; fabric-softening agents; inorganic salts such as sodium sulphate and—usually present in very minor amounts—fluorescent agents, perfumes, germicides and colourants. Additionally, other enzymes, such as amylases, lipase and cellulase, may also be incorporated, but are not essential.

It is desirable to include one or more anti-deposition agents in the cleaning composition of the invention, to decrease a tendency to form inorganic deposits on washed fabrics. The amount of any such anti-deposition agent is normally from about 0.1% to about 5% by weight, preferably from about 0.2% to about 2.5% by weight of the composition. The preferred anti-deposition agents are anionic polyelectrolytes, especially homo- or copolymeric polycarboxylic acids or salts thereof, and the organic phosphonates. Especially preferred are copolymers or salts thereof of maleic anhydride with ethylene, methylvinyl ether, acrylic acid, or methacrylic acid.

The composition of the invention may be in the form of a liquid or a solid, but is preferably presented in free-flowing particulate, e.g. powdered or granular, form, and can be produced by any of the techniques commonly employed in the manufacture of such detergent compositions, e.g. by dry mixing or by slurry-making and spray-drying processes to form a detergent base powder to which the heat-sensitive ingredients, e.g. the peroxide compound and enzymes and optionally some other ingredients as desired, are added. It is preferred that the process used to form the solid composition should result in a product having a moisture content of not more than about 12%, preferably not more than about 10% by weight. The manganese compound may be added to the composition as part of the aqueous slurry which is then dried to a particulate detergent powder, or as a dry substance mixed in with the detergent base powder.

One major advantage of the present invention is that it provides a bleaching and cleaning composition having improved stain removal and cleaning action at substantially all temperatures and hence provides a suitable and effective washing composition usable for example in washing machines at a lower than 60° C. wash cycle.

The invention will now be illustrated by way of the following non-limiting examples:

EXAMPLE I

The following particulate detergent bleach composition was prepared.

| Components | % by weight |
|---|---|
| Sodium $C_{12}$ alkyl benzene sulphonate | 6.0 |
| Fatty alcohol/7 ethylene oxide condensate | 4.0 |
| Sodium tripolyphosphate | 36.0 |
| Alkaline sodium silicate (1:2) | 8.0 |
| Sodium carboxymethylcellulose | 0.5 |
| Sodium ethylene diamine tetraacetate | 0.1 |
| Fluorescer* | 0.4 |
| Sodium sulphate | 11.0 |
| Sodium perborate tetrahydrate | 25.0 |
| Alcalase ® (proteolytic enzyme) granules | 0.4 |
| Water | 8.6 |

*Tinopal ® DMS Pure Extra ex Ciba-Geigy (microfine Dimorpholino DASCC-type fluorescer).

The above composition was used at a dosage of 5 g/liter in a series of 30 minute Tergotometer isothermal washing tests at 40° C. in 24° H. water with $MnSO_4$, $FeCl_3$, $NiCl_2$, $CuSO_4$ or $CoCl_2$ added to the washing liquor in varying amounts (ppm of metal ions) for washing tea-stained test swatches and protein-stained fest swatches (casein; Indian ink black; Iron oxide black; Iron oxide yellow, $SiO_2$, groundnut oil+emulsifiers).

The results expressed as reflectance (ΔR) in relation to metal ion concentration (ppm) in the solution are tabulated below:

1

| [Metal ion] ppm | Efficiency of stain removal at 40° C. (R) $Mn^{2+}$ on PS | $Mn^{2+}$ on TS | $Fe^{3+}$ on PS | $Fe^{3+}$ on TS | $Ni^{2+}$ on PS | $Ni^{2+}$ on TS | $Cu^{2+}$ on PS | $Cu^{2+}$ on TS | $Co^{2+}$ on PS | $Co^{2+}$ on TS |
|---|---|---|---|---|---|---|---|---|---|---|
| 0 | 14 | 3 | 14 | 3 | 14 | 3 | 14 | 3 | 14 | 3 |
| 1 | 14.1 | 3.8 | 14.0 | 1.5 | 12.0 | 2.8 | 12.5 | 2.2 | 10.8 | 5.5 |
| 5 | 14.2 | 4.0 | 14.0 | 0.3 | 11.0 | 2.5 | 8.5 | 1.7 | 6.8 | 6.6 |
| 10 | 14.4 | 4.0 | 14.0 | 0.0 | 11.0 | 2.3 | 5.8 | 1.5 | 5.3 | 7.0 |

on PS = on protein stain
on TS = on tea stain

The above results show a consistent effectiveness of manganese as a bleach catalyst without affecting the proteolytic enzyme activity on protein stains. Though iron appears not to affect proteolytic enzyme action, it reduces the bleaching effect considerably. Cobalt ions improve bleaching efficiency on tea stains, but it is very detrimental towards enzyme action.

EXAMPLE II

The following detergent bleach composition was prepared by dry mixing:

| Components | % by weight |
|---|---|
| Sodium $C_{12}$ alkyl benzene sulphonate | 15.0 |
| Sodium tripolyphosphate | 10.0 |
| Sodium orthophosphate | 20.0 |
| Sodium carboxymethylcellulose | 0.5 |
| Fluorescer* | 0.4 |

-continued

| Components | % by weight |
|---|---|
| Sodium perborate tetrahydrate | 25.0 |
| Savinase ® granules (proteolytic enzyme) | 0.4 |
| Sodium sulphate | 28.7 |

*Blankophor ® KMH 766 ex Bayer (microfine Dimorpholino DASCC-type fluorescer)

The above composition was used in the same manner as in Example I at a dosage of 5 g/liter in a series of 30 minute isothermal washing tests at 40° C. in 24° H. water (French degrees) with varying amounts of heavy metal added to the wash liquor for washing tea-stained test swatches and test swatches stained with protein as used in Example I.

The results expressed as reflectance values (ΔR) in relation to metal ion concentration (ppm) in the solution are tabulated below.

TABLE 2

| [Metal ion] ppm | Efficiency of stain removal at 40° C. (R) | | | | | | | |
|---|---|---|---|---|---|---|---|---|
| | $Mn^{2+}$ | | $Fe^{3+}$ | | $Ni^{2+}$ | | $Cu^{2+}$ | |
| | on PS | on TS | on PS | on TS | on PS | on TS | on PS | on TS |
| 0 | 17 | 4 | 17 | 4 | 17 | 4 | 17 | 4 |
| 1 | 21 | 8 | 14.8 | 2.5 | 9 | 2.7 | 3.5 | 4.8 |
| 5 | 22 | 10.8 | 14.4 | 1.6 | 8 | 2.0 | 3.0 | 3.7 |
| 10 | 22 | 11.7 | 14.9 | 1.7 | 7.8 | 2.0 | 3.0 | 0.0 |

on PS = on protein stain
on TS = on tea stain

The above results again show manganese to be the reliable metal which gives consistent improvement of stain removal at various levels on both protein and tea stains, in contrast to iron, nickel and copper.

EXAMPLES III–V

Further illustrative compositions within the scope of the invention are:

| Compositions | III | IV | V |
|---|---|---|---|
| Sodium $C_{12}$ alkylbenzenesulphonate | 6.0 | 15.0 | 7.0 |
| $C_{11}$–$C_{15}$ fatty alcohol/7 ethylene oxide | 4.0 | — | 3.5 |
| Sodium stearate soap | 2.0 | — | 4.0 |
| Sodium triphosphate | 10.0 | — | — |
| Sodium orthophosphate | 20.0 | 15.0 | 12.0 |
| Sodium pyrophosphate | — | 15.0 | — |
| Aluminosilicate (Zeolite HAB A 40 ex Degussa) | — | — | 20.0 |
| Alkaline sodium silicate (1:2) | 3.0 | 3.0 | — |
| Carboxymethylcellulose | 0.5 | 0.5 | 0.3 |
| Fluorescent agent | 0.4 | 0.4 | 0.4 |
| Sodium sulphate | 14.0 | 15.0 | 15.0 |
| Sodium perborate | 30.0 | 25.0 | 30.0 |
| Alcalase ® granules (proteolytic enzyme) | 0.5 | — | 1.0 |
| Savinase ® granules (proteolytic enzyme) | — | 1.0 | — |
| Manganous chloride ($MnCl_2$) | — | 1.5 | — |
| Manganous sulphate ($MnSO_4$) | 1.2 | — | 1.5 |
| Water | 8.4 | 9.6 | 5.3 |

I claim:

1. A bleaching and cleaning composition having improved bleaching and cleaning capacity at all washing temperatures, especially at lower temperatures, comprising:

(a) from 4 to 90% by weight of a peroxide compound bleach;

(b) from 0.001 to 10% by weight of a proteolytic enzyme; and (c) a manganese compound which yields manganese (II) cations in aqueous solution in an amount of from 0.005 to 5% by weight as manganese (II) metal ion based on the total composition.

2. A composition according to claim 1, which comprises from 0.025 to 2.5% by weight of manganese (II) metal ion.

3. A composition according to claim 2, which comprises from 0.5 to 1.0% by weight of said manganese (II) metal ion.

4. A composition according to claim 1, wherein said proteolytic enzyme is a protease obtained from a strain of Bacillus having maximum activity throughout the pH range of 8–12.

5. A composition according to claim 1, which further comprises from 2 to 50% by weight of a detergent-active material selected from the group consisting of organic anionic, nonionic, amphoteric and zwitterionic detergents and mixtures thereof.

6. A composition according to claim 1, which further comprises from 5 to 90% by weight of a detergency builder.

7. A composition according to claim 1, which comprises from 4 to 35% by weight of said peroxide compound bleach.

8. A composition according to claim 1, wherein said peroxide compound bleach is an alkali metal perborate.

9. A composition according to claim 1, having a proteolytic activity of from 2 to 20 Anson Units per kilogram.

10. An alkaline bleaching and cleaning agent having improved bleaching and cleaning capacity at all washing temperatures and especially at lower temperatures, comprising:

(i) from 2 to 50% by weight of a detergent-active material, selected from the group consisting of organic anionic, nonionic, amphoteric and zwitterionic detergents and soaps, and mixtures thereof;

(ii) from 15 to 60% by weight of a detergency builder salt;

(iii) from 4 to 35% by weight of a peroxide compound bleach;

(iv) from 0.001 to 10% by weight of a proteolytic enzyme; and (v) from 0.005 to 5% by weight of manganese (II) metal ion.

such that the composition has a solution pH of from 8–13 and a proteolytic activity of from 2 to 20 Anson Units per kilogram.

* * * * *